US006286623B1

(12) United States Patent
Shaya

(10) Patent No.: US 6,286,623 B1
(45) Date of Patent: Sep. 11, 2001

(54) SOUND-ATTENUATING MUFFLER FOR INTERNAL COMBUSTION ENGINE

(75) Inventor: Zvi Shaya, Rishon Lezion (IL)

(73) Assignee: Silent Exhaust Systems Ltd., Kiryat Gat (IL)

( * ) Notice: Subject to any disclaimer, the term of this patent is extended or adjusted under 35 U.S.C. 154(b) by 0 days.

(21) Appl. No.: 09/628,110

(22) Filed: Jul. 27, 2000

(51) Int. Cl.[7] ..... F01N 1/08
(52) U.S. Cl. ..... 181/264; 181/272
(58) Field of Search ..... 181/264, 268, 181/269, 270, 272, 273, 275, 276, 281, 282

(56) References Cited

U.S. PATENT DOCUMENTS

| | | | | |
|---|---|---|---|---|
| 624,062 | * | 5/1899 | Mattews et al. | 181/264 |
| 2,971,599 | | 2/1961 | Tobias . | |
| 3,029,895 | | 4/1962 | Lyon . | |
| 3,029,896 | | 4/1962 | Lyon . | |
| 4,574,914 | | 3/1986 | Flugger . | |
| 5,925,857 | | 7/1999 | Birkel et al. . | |
| 5,962,822 | * | 10/1999 | May | 181/264 |
| 6,050,363 | * | 4/2000 | Tu | 181/264 |

* cited by examiner

*Primary Examiner*—Khanh Dang
(74) *Attorney, Agent, or Firm*—Mark M. Friedman

(57) ABSTRACT

A muffler for an internal combustion engine having characteristically low back pressure and a pleasing sound is disclosed. The muffler comprises: (a) an elongated housing having an interior wall and including: (i) an inlet opening formed for the flow of exhaust gas into the housing, and (ii) an outlet opening formed for the discharge of exhaust gas from the housing; and (b) a partition shaped like a hollow pyramid, disposed in the housing and having interior surfaces and exterior surfaces, the exterior surfaces joining at a first end to form a pyramidal apex, the pyramidal apex pointing toward the inlet opening, and extending at a second end to form a rugose base, wherein the partition is disposed in the housing to form a plurality of spaces between the rugose base and the housing for the flow of exhaust gas.

17 Claims, 4 Drawing Sheets

SOUND-ATTENUATING MUFFLER FOR INTERNAL COMBUSTION ENGINE

FIELD AND BACKGROUND OF THE INVENTION

The present invention relates to sound-attenuating mufflers for internal combustion engines and, more particularly, to sound-attenuating mufflers generating reduced back pressure.

Numerous muffler constructions have been proposed for the attenuation of the sound component of an exhaust gas stream from an internal combustion engine. Such mufflers are designed towards achieving appreciable sound attenuation, but without substantially increasing the back pressure on the engine, which results in power loss, reduced engine efficiency, and higher fuel consumption.

In surveying the prior art, U.S. Pat. No. 4,574,914 to Flugger teaches that although the patent art contains various muffler constructions which purport to solve the problem of sound attenuation without undesirable back pressure, in reality these various structures have substantial performance deficiencies. It is well known to provide a divergently tapered centrally located conical partition for flow of gases around the partition to effect an expansion of the gases. Typical of such structures are the devices shown in U.S. Pat. Nos. 2,071,351, 2,239,549 and 2,971,599.

Some of these patented mufflers follow such an expansion partition or cone with a contraction or concentrating partition or baffle. Typical of such devices are the mufflers shown in U.S. Pat. Nos. 1,081,348, 2,667,940, 3,029,895 and 3,029,896. These mufflers, however, do significantly increase back pressure by causing the exhaust gases to reverse the direction of their flow axially as they attempt to pass beyond the concentrating or converging baffle. This flow reversal may be effective in sound attenuation, but it has been found to increase back pressure undesirably.

Even mufflers which employ alternating divergent and then convergent partitions have suffered from undesirable bulk and/or weight, inordinate complexity, or auxiliary flow channels or openings in the partitions which defeat sound attenuation. Typical of such mufflers are the mufflers set forth in U.S. Pat. Nos. 624,062, 1,184,431, 2,325,905 and 2,485,555.

Thus, U.S. Pat. No. 4,574,914 to Flugger concludes that while the successive outward deflection and then inward convergence of gases in a muffler is broadly known in the prior art, such prior art structures typically have partitions or baffle structures which induce undesirable back pressure, contain openings or passageways which diminish the sound attenuating effectiveness of the muffler, or require excessive length, diameter and/or weight.

The inventive muffler disclosed in U.S. Pat. No. 4,574,914 to Flugger is a compact, sound-attenuating muffler for a high-performance internal combustion engine in which the muffler casing has an elongated transverse cross-section with a height dimension of only slightly larger than the height dimension of the inlet exhaust pipe and a width dimension in the range of about 2 to 4½ times the height dimension. The muffler includes a divergently tapering planar first partition which causes gases to be expanded only in a horizontal plane toward the side walls of the muffler and further includes a second partition formed to contract or converge the gases in a horizontal plane toward a central opening. The first partition has a cup-shaped back surface so that contraction of the gases around the back side of the first partition is highly effective in attenuating sound, and both partitions are sloped in a direction toward the outlet from the muffler so as to minimize the generation of back pressure, which is not substantially greater than the back pressure in a straight pipe.

The muffler disclosed in U.S. Pat. No. 4,574,914 is designed explicitly for high-performance internal combustion engines for racing cars and the like. Although the back pressure generated by such mufflers is reported to produce a power loss of less than 2%, the sound level reduction associated with this power loss is from 130 db on the A scale to about 90 db on the A scale. A sound level of about 90 db on the A scale is completely unacceptable for common passenger vehicles and the like.

There is therefore a recognized need for, and it would be highly advantageous to have, an exhaust system providing a combination of improved sound attenuation and reduced back pressure generation, yet is simple, compact, lightweight, and easy to fabricate.

SUMMARY OF THE INVENTION

According to the teachings of the present invention there is provided a muffler for an internal combustion engine having characteristically low back pressure and a pleasing sound. The muffler comprises: (a) an elongated housing having an interior wall and including: (i) an inlet opening formed for the flow of exhaust gas into the housing, and (ii) an outlet opening formed for the discharge of exhaust gas from the housing; and (b) a partition shaped like a hollow pyramid, disposed in the housing and having interior surfaces and exterior surfaces, the exterior surfaces joining at a first end to form a pyramidal apex, the pyramidal apex pointing toward the inlet opening, and extending at a second end to form a rugose base, wherein the partition is disposed in the housing to form a plurality of spaces between the rugose base and the housing for the flow of exhaust gas.

According to further features in the described preferred embodiments, the flow of exhaust gas through the inlet opening is directed towards the pyramidal apex, thereby causing the flow of the exhaust gas to be, and wherein the exhaust gas flows across the rugose base of the exterior surfaces before being discharged through the outlet opening.

According to yet another aspect of the present invention there is provided a muffler for receiving and discharging a flow of exhaust gas from an internal combustion engine, the muffler comprising: (a) an elongated housing having an interior wall, the housing including: (i) an inlet opening formed for the flow of exhaust gas into the housing, and (ii) an outlet opening formed for the discharge of exhaust gas from the housing; and (b) a partition disposed in the housing and having interior surfaces and exterior surfaces, the exterior surfaces joining at a first end to form an apex, the apex pointing toward the inlet opening, and flaring out at a second end to form a rugose base, wherein the partition is disposed in the housing to form a plurality of spaces between the rugose base and the housing for the flow of exhaust gas, and wherein the flow of exhaust gas through the inlet opening is directed towards the apex, thereby causing the flow of the exhaust gas to be deflected along the exterior surfaces and towards the interior wall of the housing, and wherein the exhaust gas flows across the rugose base of the exterior surfaces before being discharged through the outlet opening.

According to still further features in the described preferred embodiments, the flow of the exhaust gas is deflected along the exterior surfaces in substantially all directions.

According to still further features in the described preferred embodiments, a first portion of the exhaust gas flows directly beyond the rugose base, and a second portion of the exhaust gas flows in a substantially reverse fashion along the interior surfaces. According to still further features in the described preferred embodiments, the ratio of the second portion to the first portion is between 0.1 to 1.0 and 0.3 to 1.0.

According to still further features in the described preferred embodiments, the plurality of spaces includes at least one space having an inverted V shape.

According to still further features in the described preferred embodiments, the partition has a plurality of ears extending from the rugose base, each of the plurality of ears substantially contacting the housing, thereby providing no-flow zones between the plurality of spaces.

According to still further features in the described preferred embodiments, the interior wall is substantially curvilinear or substantially rectangular.

According to still further features in the described preferred embodiments, the muffler further comprises: (c) a converging, hollow truncated-cone partition, disposed in the housing such that the flow of exhaust gas through the inlet opening is directed towards the apex.

According to still further features in the described preferred embodiments, the muffler further comprises: (c) a converging, hollow truncated-cone partition, disposed in the housing such that the flow of exhaust gas coming from the pyramidal partition is centered transversely within the housing.

The present invention successfully addresses the shortcomings of the existing technologies by providing a muffler that reduces back pressure appreciably relative to conventional mufflers of the prior art, while achieving satisfactory levels of sound attenuation. Moreover, it has been found that the type of sound emitted by the muffler is unique, having a soothing reverberating tone instead of the harsh sounds emitted by standard mufflers. Finally, the muffler of the present invention is of simple and reliable design, and is inexpensive to manufacture.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
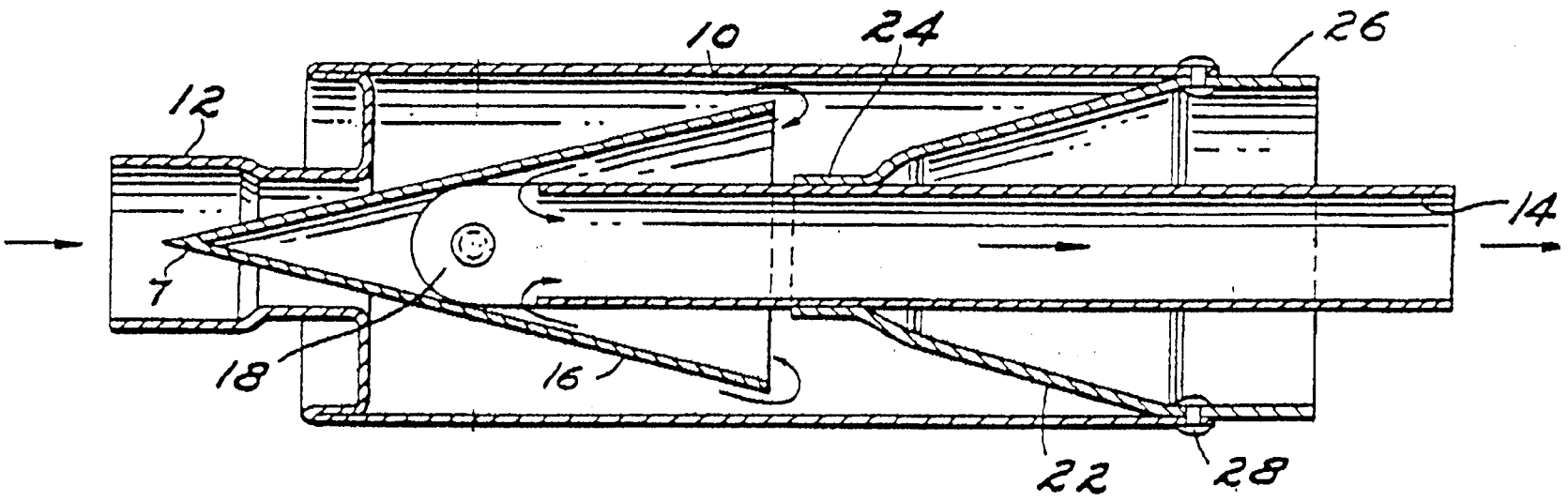
Fig. 1 (prior art)
FIG. 1 is a sectional view through a muffler embodying the prior art of U.S. Pat. No. 2,971,599 to Tobias.

FIG. 1 is a sectional view through a muffler embodying the prior art of U.S. Pat. No. 2,971,599 to Tobias.

The muffler comprises a housing 10 that is provided at one end with an inlet pipe 12. Inlet pipe 12 is of reduced diameter as compared with the diameter of the casing and is adapted to be coupled with an exhaust leading from the engine. There is a discharge pipe 14 which is shown as of substantially the same diameter as that portion of the inlet pipe 12 which enters the casing.

There is a tapered tubular baffle 16 which is supported within the casing between the inlet pipe 12 and the discharge pipe 14. The baffle shown is of a conical shape and closed at its reduced end 7. The reduced end 7 extends into the inlet pipe 12. The enlarged rear end of the baffle 16 surrounds and overlaps the adjacent end of the discharge pipe 14. It will be seen that the tubular baffle 16 is so fastened to the ears 18 of the discharge pipe 14 that a flow passageway is provided through the interior of the baffle 16 into the end of the discharge pipe between the ears 18.

Baffle 22 is a tubular tapered baffle generally in the form of a truncated cone. The small end of this baffle encircles and is connected with discharge pipe 14 at 24. The opposite flaring end 26 of this baffle 22 is connected by rivets 28 or the like with the discharge end of the casing 10. The second baffle 22 therefore constitutes a closure -that extends from the inner wall of the casing 10 forwardly to the discharge pipe 14. In operation it will be seen that exhaust gas from the engine enters the casing through the inlet pipe 12, flows over the tapered end of the baffle 16 rearwardly within the casing and is directed by the baffle 22 to flow forwardly into the cone-shaped baffle 16. It will be seen that the cone-shaped baffle 16 overhangs for a substantial portion of its length the discharge pipe 14 and the exhaust gas entering the baffle 16 flows downwardly therethrough and into the discharge pipe between the ears 18. The exhaust gas is then discharged through the opposite end of the pipe U.S. Pat. No. 2,971,599 discloses that the flow of the exhaust gas is sufficiently smooth that a minimum of back pressure is set up within the baffle, while the gas stream is directed such that undesirable noise is effectively silenced.

It has been established by U.S. Pat. No. 4,574,914 to Flugger, however, that mufflers of this type significantly increase back pressure by causing the exhaust gases to reverse the direction of their flow axially as they attempt to pass beyond the concentrating or converging baffle. Although such flow reversal may be effective in sound attenuation, it has been found to increase back pressure undesirably.

Figure 2:
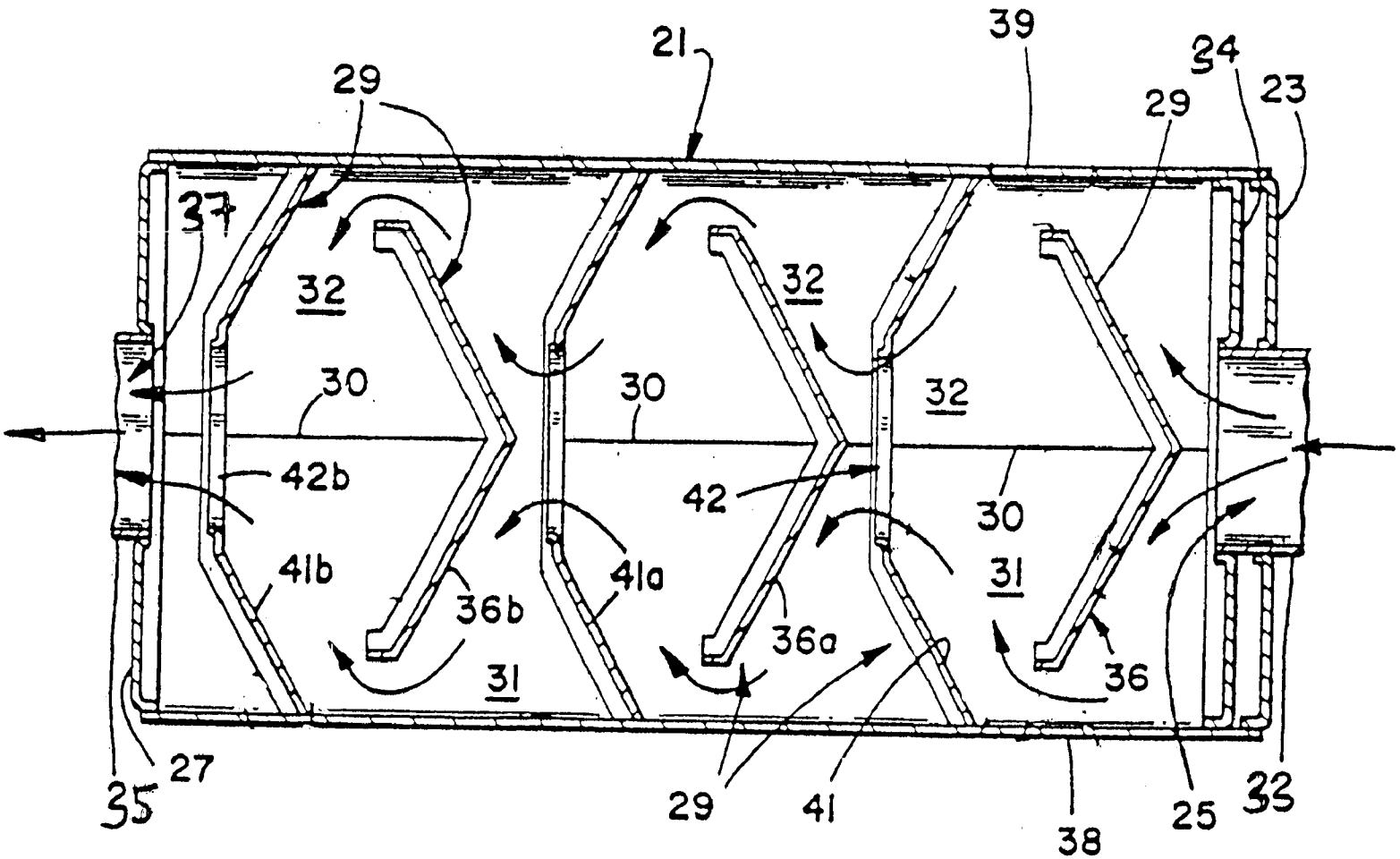
Fig. 2 (prior art)
FIG. 2 is a sectional view of a muffler for high-performance internal combustion engines, according to U.S. Pat. No. 4,574,914 to Flugger.

The muffler disclosed by U.S. Pat. No. 4,574,914 is a muffler for high-performance internal combustion engines. A sectional view of this prior art muffler is provided in FIG. 2. The muffler includes a casing, generally designated 21, an inlet pipe 33 extending through casing end wall members 23 and 34 for the flow of exhaust gases through inlet opening 25 into casing 21. The muffler further includes an outlet pipe 35 mounted to extend through casing end wall 27 and provide an outlet opening 37 for the discharge of gases from the casing. Mounted in casing 21 is partition means, generally designated 29, which is formed for the attenuation of the sound component in the exhaust gases as the gases pass through the muffler.

Partition means 29 includes a first partition 36 which is divergently tapered from the longitudinal center line of the casing, which coincides with seam 30 between casing halves 31 and 32. First partition 36 deflects gases passing through inlet opening 25 from inlet exhaust pipe 33 outwardly toward the side walls 38 and 39 of casing 21. Mounted downstream of partition 36 is a second partition 41 which is formed to be convergently tapered with respect to the central longitudinal axis of the muffler. Partition 41 is formed with central opening means 42 so that gases converging from walls 38 and 39 pass through central opening 42, at which point they are discharged from the casing or, as shown in the drawing, impact an additional first partition 36*a*. In the muffler shown in the drawing, the divergence and convergence of the exhaust stream is repeated, with the exhaust gases being deflected by an additional second partition 41*a*, still another first partition 36*b* and finally an additional second partition 41*b*, which discharges the gases through opening 42*b* into outlet opening 28 and outlet exhaust pipe 26.

U.S. Pat. No. 4,574,914 to Flugger teaches a muffler that achieves extremely effective sound attenuation without undesirable back pressure and bulk or weight by forming casing 21 with a transverse cross section having a width dimension substantially greater than the height. U.S. Pat. No. 4,574,914 further discloses that the muffler includes three sets of first and second partitions. Each set of partitions will attenuate the sound component in the exhaust gases by about ½ to ⅔ of the sound level in the incoming gases. Thus, three sets of partitions can be used to reduce the sound level on an 800 horsepower engine during maximum acceleration from about 130 db on the A scale (about 5,000 watts) to about 90 db on the A scale (about one tenth of a watt).

From the above description of the prior art, it is evident that:

1. Conical partitions having reverse flow patterns cause excessive back pressure.

2. The sound attenuation device of Flugger reduces the noise level of the exhaust by forcing the exhaust out along the interior sides of the casing. Such a device is ineffective for mufflers in which the casing width is not substantially larger than the casing height.

3. Even with the requisite width-to-height ratio, and even with three sets of partitions, the sound attenuation device of Flugger does not achieve the requisite sound attenuation for ordinary passenger vehicles.

In general, there exists a trade-off between sound attenuation and back pressure. Thus, the mufflers having conical partitions are capable of achieving the sound attenuation required for ordinary passenger vehicles, but at the cost of appreciable back pressure and reduced engine performance and efficiency. It has been discovered by the inventor, however, that it is not the conical partition geometry per se that causes the excessive back pressure, rather, it is the configuration that forces the entire exhaust gas flow to reverse direction through the inside of the cone. However, when the muffler is configured like an ejector, in which a portion of the gas continues to flow in the direction of the outlet pipe, thereby creating a low pressure region inside the cup of the cone, the back pressure is greatly reduced.

It has been further discovered by the inventor that by providing the muffler partition with a rugose base, i.e., with a base that is curved and/or angled, the muffler performance is improved. This is particularly true for muffler partitions having a hollow pyramidal structure, wherein the partition is disposed in the housing to form spaces between the rugose base and the housing for the flow of exhaust gas. This is described in further detail below.

It has been further discovered by the inventor that muffler performance is improved by providing no-flow zones between the spaces.

The principles and operation of the muffler according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawing. The invention is capable of other embodiments or of being practiced or carried out in various ways. Also, it is to be understood that the phraseology and terminology employed herein is for the purpose of description and should not be regarded as limiting.

Figure 3:
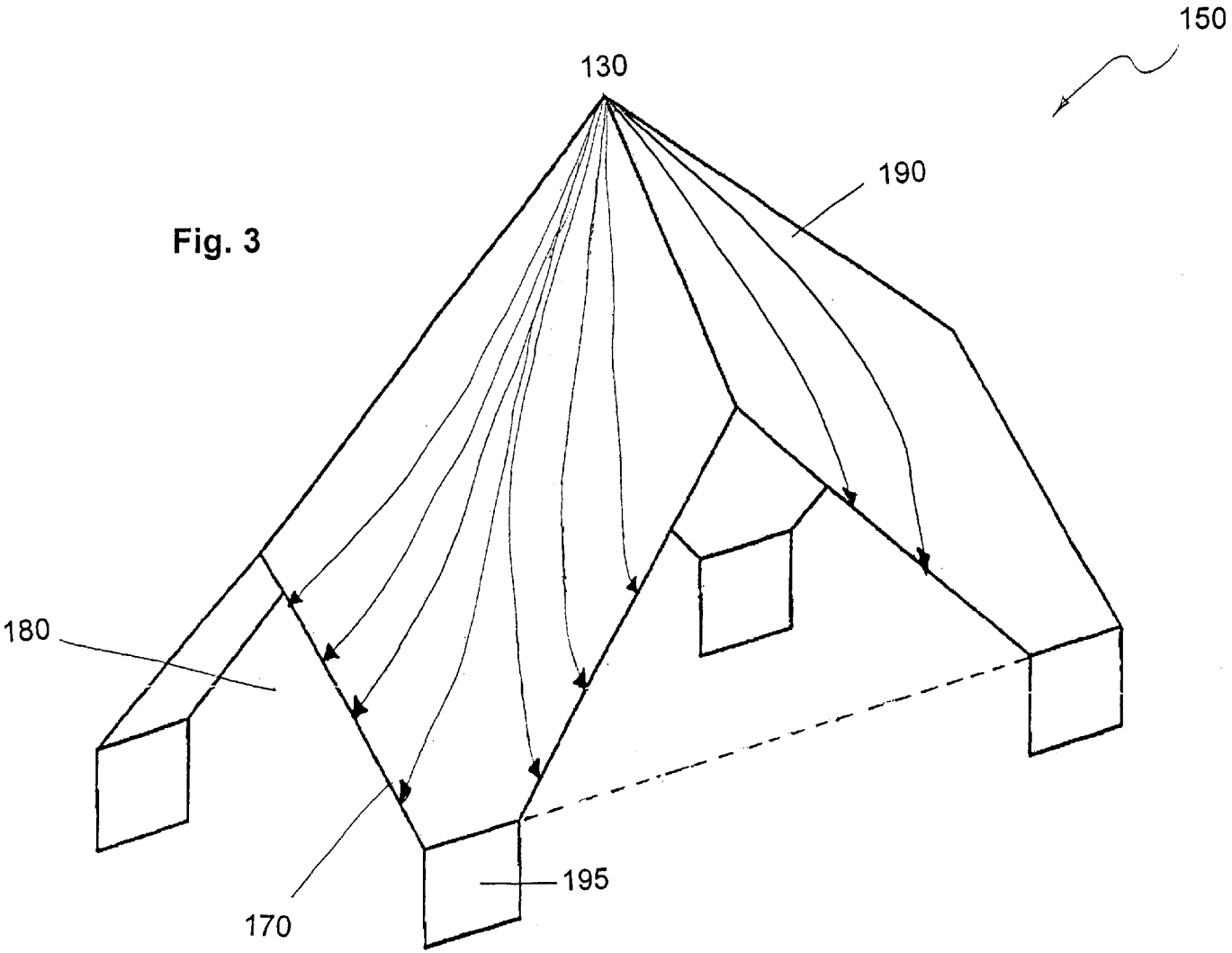
FIG. 3 is an illustration of the pyramidal partition according to the present invention.

Referring now to the drawings of the present invention, FIG. 3 is an illustration of the main partition, pyramidal partition 150. Pyramidal partition 150 has four faces (two shown), each face 190 meeting at apex 130. Pyramidal partition 150 is hollow, and the distal end of pyramidal partition 150 is provided with four spaces, each space 180 shaped like an inverted V, at 90° angles along the rugose base 170 of the partition 150. Also provided at the base of each facing are ears 195 for welding the partition 150 to the muffler housing (shown below in FIG. 4).

Figure 4:
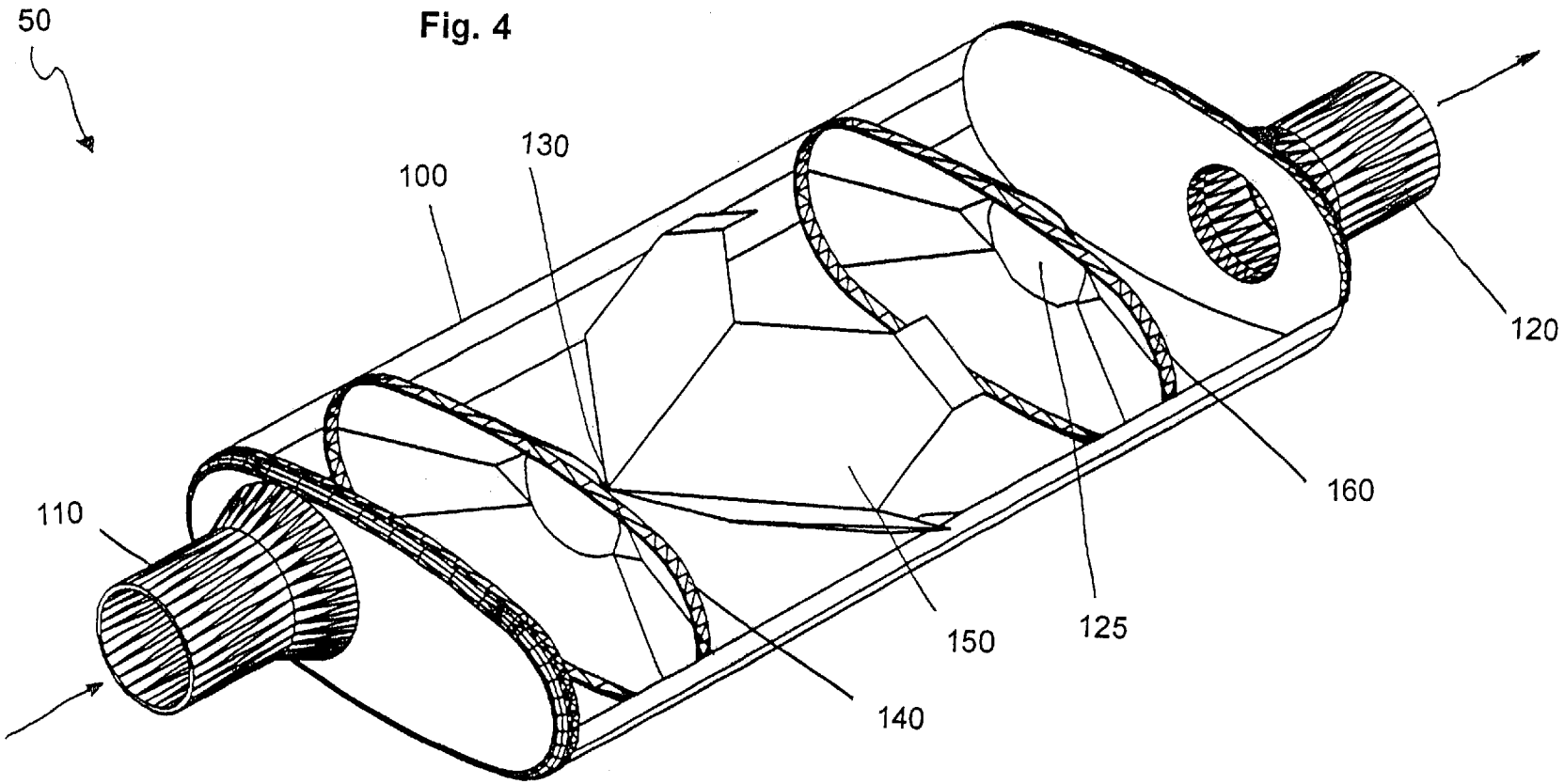
FIG. 4 is a cut open view of a muffler unit containing the pyramidal partition of FIG. 3.

A cut open view of the muffler 50 is shown in FIG. 4. The muffler 50 consists of an elongated housing 100 having an inlet 110 for introducing the exhaust gas, an outlet 120 for discharging the exhaust gas, the pyramidal partition 150 of FIG. 3, and converging partitions 140 and 160.

The exhaust gas from the internal combustion engine is introduced through the inlet 110, which is located towards one side of the short side of housing 100. The exhaust gas enters the housing 100 and flows through partition 140 in the long direction of the housing. Partition 140 is shaped like a funnel (or truncated pyramid), disposed such that the hollow base of the partition 140 faces the flow of exhaust gas. Thus, the exhaust gas flow is centered within the housing 100. The exhaust gas flow then meets the apex 130 of pyramidal partition 150, causing the flow to be deflected along the exterior faces 190 of pyramidal partition 150 and towards the interior wall of housing 100.

The exhaust gas flows into the four spaces formed by the rugose base (see also FIG. 3) of the pyramidal partition 150. A substantial portion of the exhaust gas continues to flow in the direction of the outlet pipe 120, thereby creating a low pressure region inside the pyramidal partition 150. Consequently, a second portion of the exhaust gases changes directions and enters (is drawn into) the inside of pyramidal partition 150 before continuing in the direction of the outlet pipe 120. The exhaust gases flow through converging partition 160, which is substantially identical in shape and in disposition to converging partition 140. Thus, the exhaust gas flow is centered within the housing 100 by the partition outlet 125 before being discharged through outlet pipe 120.

Partition 160 can be fabricated such that the partition outlet 125 is directly opposite the outlet pipe 130. Moreover, when the inlet pipe 110 is centrally disposed in the short side of housing 100, partition 140 is not necessary. Similarly, when the outlet pipe 120 is centrally disposed in the short side of housing 100 distal to the inlet pipe 110, partition 160 is not necessary.

The present muffler reduces back pressure appreciably relative to conventional mufflers of the prior art, while achieving satisfactory levels of sound attenuation. While not wishing to be bound by any particular theory, the authors utilize well-known and established theory and attribute the reduced back pressure to the relatively free flow of the exhaust gases through the muffler, as contrasted with the flow in standard mufflers in which the exhaust gases are caused to follow a tortuous route, changing direction several times and completely reversing direction.

Referring back to FIG. 3, the sound attenuation achieved in the inventive muffler can be attributed to a number of factors, one of which is the change in direction of the gases flowing across the rugose base 170 of the pyramidal partition 150.

Another important contribution to sound attenuation results from the no-flow zones near each ear 195 of the pyramidal partition 150. In addition to the ears physically stopping the sound waves, and perhaps more importantly, the zero-velocity boundary condition at each ear 195 forces the flow of exhaust gas to curve around the ear 195 from each side. This unique flow pattern may also be the cause of the soothing, reverberating tone emitted by the muffler of the present invention as opposed to the harsh sounds emitted by many standard mufflers.

Pyramidal partition 150 can be replaced with a conical shape having a rugose base. However, the performance of the pyramidal partition has been found to be appreciably better, i.e., for a given back pressure, the sound attenuation achieved and the quality of the tone emitted by the muffler were both considerably improved relative to the conical partition.

As used herein in the specification and in the claims section that follows, the term "pyramid", "pyramidal partition", and the like refer to a hollow figure having faces that meet at a common point. The point is referred to as the "apex" of the pyramid.

As used herein in the specification and in the claims section that follows, the term "rugose base" refers to a pyramid base that, unlike conventional pyramid bases, is curved and/or angled, such that with the pyramid situated in the muffler housing, spaces between the sides of the pyramid and the housing are formed, through which the passage of exhaust gases is enabled.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A muffler for receiving and discharging a flow of exhaust gas from an internal combustion engine, the muffler comprising:

(a) an elongated housing having an interior wall, said housing including:
  (i) an inlet opening formed for the flow of exhaust gas into said housing, and
  (ii) an outlet opening formed for the discharge of exhaust gas from said housing; and (b) a partition disposed in said housing and having interior surfaces and exterior surfaces, said exterior surfaces joining at a first end to form an apex, said apex pointing toward said inlet opening, and flaring out at a second end to form a rugose base, wherein said partition is disposed in said housing to form a plurality of spaces between said rugose base and said housing for the flow of exhaust gas, and wherein the flow of exhaust gas through said inlet opening is directed towards said apex, thereby causing the flow of the exhaust gas to be deflected along said exterior surfaces and towards said interior wall of said housing, and wherein the exhaust gas flows across said rugose base of said exterior surfaces before being discharged through said outlet opening.

2. The muffler of claim 1, wherein the flow of the exhaust gas is deflected along said exterior surfaces in substantially all directions.

3. The muffler of claim 2, wherein a first portion of the exhaust gas flows directly beyond said rugose base, and a second portion of the exhaust gas flows in a substantially reverse fashion along said interior surfaces.

4. The muffler of claim 3, wherein the ratio of said second portion to said first portion is between 0.1 to 1.0 and 0.3 to 1.0.

5. The muffler of claim 1, wherein said plurality of spaces includes at least one space having an inverted V shape.

6. The muffler of claim 1, wherein said partition has a plurality of ears extending from said rugose base, each of said plurality of ears substantially contacting said housing, thereby providing no-flow zones between said plurality of spaces.

7. A muffler for receiving and discharging a flow of exhaust gas from an internal combustion engine, the muffler comprising:

(a) an elongated housing having an interior wall, said housing including:
  (i) an inlet opening formed for the flow of exhaust gas into said housing, and
  (ii) an outlet opening formed for the discharge of exhaust gas from said housing; and deflected along said exterior surfaces and towards said interior wall of said housing;

(b) a partition shaped like a hollow pyramid, disposed in said housing and having interior surfaces and exterior surfaces, said exterior surfaces joining at a first end to form a pyramidal apex, said pyramidal apex pointing toward said inlet opening, and extending at a second end to form a rugose base, wherein said partition is disposed in said housing to form a plurality of spaces between said rugose base and said housing for the flow of exhaust gas.

8. The muffler of claim 7, wherein the flow of exhaust gas through said inlet opening is directed towards said pyramidal apex, thereby causing the flow of the exhaust gas to be deflected along said exterior surfaces and towards said interior wall of said housing, and wherein the exhaust gas flows across said rugose base of said exterior surfaces before being discharged through said outlet opening.

9. The muffler of claim 8, wherein the flow of the exhaust gas is deflected along said exterior surfaces in substantially all directions.

10. The muffler of claim 8, wherein a first portion of the exhaust gas flows directly beyond said rugose base, and a second portion of the exhaust gas flows in a substantially reverse fashion along said interior surfaces.

11. The muffler of claim 10, wherein the ratio of said second portion to said first portion is between 0.1 to 1.0 and 0.3 to 1.0.

12. The muffler of claim 7, wherein said plurality of spaces includes at least one space having an inverted V shape.

13. The muffler of claim 7, wherein said partition has a plurality of ears extending from said rugose base, each of said plurality of ears substantially contacting said housing, thereby providing no-flow zones between said plurality of spaces.

14. The muffler of claim 7, wherein said interior wall is substantially curvilinear.

15. The muffler of claim 7, wherein said interior wall is substantially rectangular.

16. The muffler of claim 7, further comprising:

(c) a converging, hollow truncated-cone partition, disposed in said housing such that the flow of exhaust gas through said inlet opening is directed towards said pyramidal apex.

17. The muffler of claim 7, further comprising:

(c) a converging, hollow truncated-cone partition, disposed in said housing such that the flow of exhaust gas coming from said pyramidal partition is centered transversely within said housing.

* * * * *